US009844732B2

(12) United States Patent
Fisher

(10) Patent No.: US 9,844,732 B2
(45) Date of Patent: Dec. 19, 2017

(54) WATER SLIDE HAVING AXIALY ROTATABLE WATERSLIDE VEHICLE

(71) Applicant: Skyturtle Technologies Ltd., Enderby (CA)

(72) Inventor: Lance Fisher, Enderby (CA)

(73) Assignee: Skyturtle Technologies Ltd., Enderby (CA)

( * ) Notice: Subject to any disclaimer, the term of this patent is extended or adjusted under 35 U.S.C. 154(b) by 0 days.

(21) Appl. No.: 14/893,488

(22) PCT Filed: May 21, 2014

(86) PCT No.: PCT/CA2014/050472
§ 371 (c)(1),
(2) Date: Nov. 23, 2015

(87) PCT Pub. No.: WO2014/186895
PCT Pub. Date: Nov. 27, 2014

(65) Prior Publication Data

US 2016/0166942 A1 Jun. 16, 2016

Related U.S. Application Data

(60) Provisional application No. 61/825,773, filed on May 21, 2013.

(51) Int. Cl.
*A63G 21/18* (2006.01)
*B63B 35/73* (2006.01)
(Continued)

(52) U.S. Cl.
CPC ..... *A63G 21/18* (2013.01); *B63B 7/00* (2013.01); *B63B 35/73* (2013.01); *B63B 35/81* (2013.01)

(58) Field of Classification Search
CPC ..... A63G 21/00; A63G 21/18; A63G 31/00; A63G 31/007; A63G 3/00; A63G 3/06;
(Continued)

(56) References Cited

U.S. PATENT DOCUMENTS 2,064,035 A * 12/1936 Rynearson ..... A63G 3/06 104/71
4,821,647 A * 4/1989 Powell ..... B61L 23/002 104/125
(Continued)

OTHER PUBLICATIONS

International Searching Authority, Written Opinion and International Search Report, PCT/CA2014/050472, dated Jul. 22, 2014, 8 pages.

*Primary Examiner* — Kien Nguyen
(74) *Attorney, Agent, or Firm* — Schacht Law Office, Inc.; Dwayne Rogge

(57) ABSTRACT

A vehicle for conveying a rider within a tubular track comprises a support portion for supporting the rider and a retaining body adapted to retain the support portion against an interior wall of the tubular track. The retaining body has a sliding surface for slidable engagement with the wall of the tubular track. The support portion and the retaining body have a vehicle axis of movement about which the vehicle may rotate within the tubular track. An apparatus for transporting a rider comprises a tubular track having an interior wall and at least one vehicle.

19 Claims, 9 Drawing Sheets

(51) Int. Cl.
*B63B 35/81* (2006.01)
*B63B 7/00* (2006.01)

(58) Field of Classification Search
CPC A63B 2225/605; A63B 67/007; A63H 23/00; A63H 23/10
USPC ..... 472/117, 128, 129, 13; 104/53, 69, 70
See application file for complete search history.

(56) References Cited

U.S. PATENT DOCUMENTS

| | | | | |
|---|---|---|---|---|
| 5,193,462 | A | 3/1993 | Marcu | |
| 6,058,848 | A * | 5/2000 | Futami | A63G 3/06 104/71 |
| 6,066,049 | A * | 5/2000 | Milanian | A63G 3/06 472/128 |
| 6,413,165 | B1 | 7/2002 | Crandall et al. | |
| 6,527,646 | B1 * | 3/2003 | Briggs | A63G 21/18 104/69 |
| 6,595,861 | B1 * | 7/2003 | Morrow | E04H 4/0025 4/488 |
| 7,497,784 | B2 | 3/2009 | Henry | |
| 7,918,741 | B2 * | 4/2011 | Hunter | A63G 3/02 104/72 |
| 8,241,133 | B1 * | 8/2012 | Lewis | A63G 31/16 104/53 |
| 2009/0118024 | A1 * | 5/2009 | Yule | A63G 21/18 472/128 |

* cited by examiner

WATER SLIDE HAVING AXIALY ROTATABLE WATERSLIDE VEHICLE

CROSS REFERENCE TO RELATED APPLICATION

This application claims priority from U.S. Provisional Patent Application No. 61/825,773 filed May 21, 2014 entitled AXIAL ROTATABLE WATERSLIDE VEHICLE.

BACKGROUND OF THE DISCLOSURE

Field of Disclosure

The present disclosure relates to a waterslide vehicle that typically slides on one surface.

Description of Related Art

Water slides are a common and popular recreational activity. Water slides commonly comprise a track (commonly also referred to as a water slide) formed of a substantially tubular, tubular section, or contoured track with a flow of water therein. The water slide traveling from the beginning or top (uppermost region) to the end or bottom (lowermost region) to convey a rider for the enjoyment of the rider. Conventional water slides rely on a substantially open-topped channel (tube) in which the rider is conveyed. Disadvantageously, such designs rely upon gravity to retain the rider within the water slide thereby limiting possible designs and layouts.

SUMMARY OF THE DISCLOSURE

In one example, there is disclosed a vehicle for conveying a rider within a substantially tubular track comprising a support portion for supporting the rider and a retaining body adapted to retain the support portion against an interior wall (surface) of the tubular track. The retaining body has a sliding surface for slidable engagement with the wall of the tubular track. In one example, the support portion and the retaining body have a vehicle axis of movement about which the vehicle may rotate within the tubular track.

The support portion in one example may comprise a substantially planar (flat) body adapted to support a rider thereon. The support portion may be sized to receive a single prone rider.

The substantially planar body may include a barrier extending around a periphery thereof. The barrier may be cushioned. The barrier may be inflatable. The planar body may be inflatable.

The planar body may extend substantially parallel to the vehicle axis. The planar body may include a harness means for securing a rider thereto.

The retaining body may comprise a ring extending from the support portion around the vehicle axis. The vehicle may further comprise a plurality of retaining bodies. The ring may comprise a rigid body having a low resistance exterior surface oriented radially outwards. The retaining body may comprise an arcuate member extending along the length of the support portion.

The retaining body may comprise a shell extending from the support portion. The shell may be domed. The shell may comprise a semi-cylindrical shell mateable to the support portion. The support portion may comprise a semi-cylindrical body adapted to form a cylinder in cooperation with the shell. The shell and the support portion may be co-formed with each other.

The vehicle may further comprise a plurality of support portions operably connected to each other along a common axis such that the retaining body is located on a bottom surface of each support portion wherein the plurality of retaining bodies maintain the plurality of support portions within the tubular track. The retaining body may be formed of an inflatable body.

The vehicle may further comprise a plurality of support portions extending radially from an axis of the vehicle wherein each support portion includes a retaining body located at an outer radial surface thereof.

According to a further embodiment of the disclosure there is disclosed an apparatus for transporting a rider comprising a tubular track having an interior wall and at least one vehicle. Each vehicle comprising a retaining body adapted to retain the support portion against an interior wall of the tubular track, the retaining body having a sliding surface for slidable engagement with the wall of the tubular track. The support portion and retaining body have a vehicle axis of movement about which the vehicle may rotate within the tubular track.

Other aspects and features of the disclosure will become apparent to those ordinarily skilled in the art upon review of the following description of specific examples of the disclosed apparatus in conjunction with the accompanying Figs.

BRIEF DESCRIPTION OF THE DRAWINGS

In the drawings which illustrate examples of the disclosed apparatus wherein similar characters of reference denote corresponding parts in each view.

DETAILED DESCRIPTION

Figure 1:
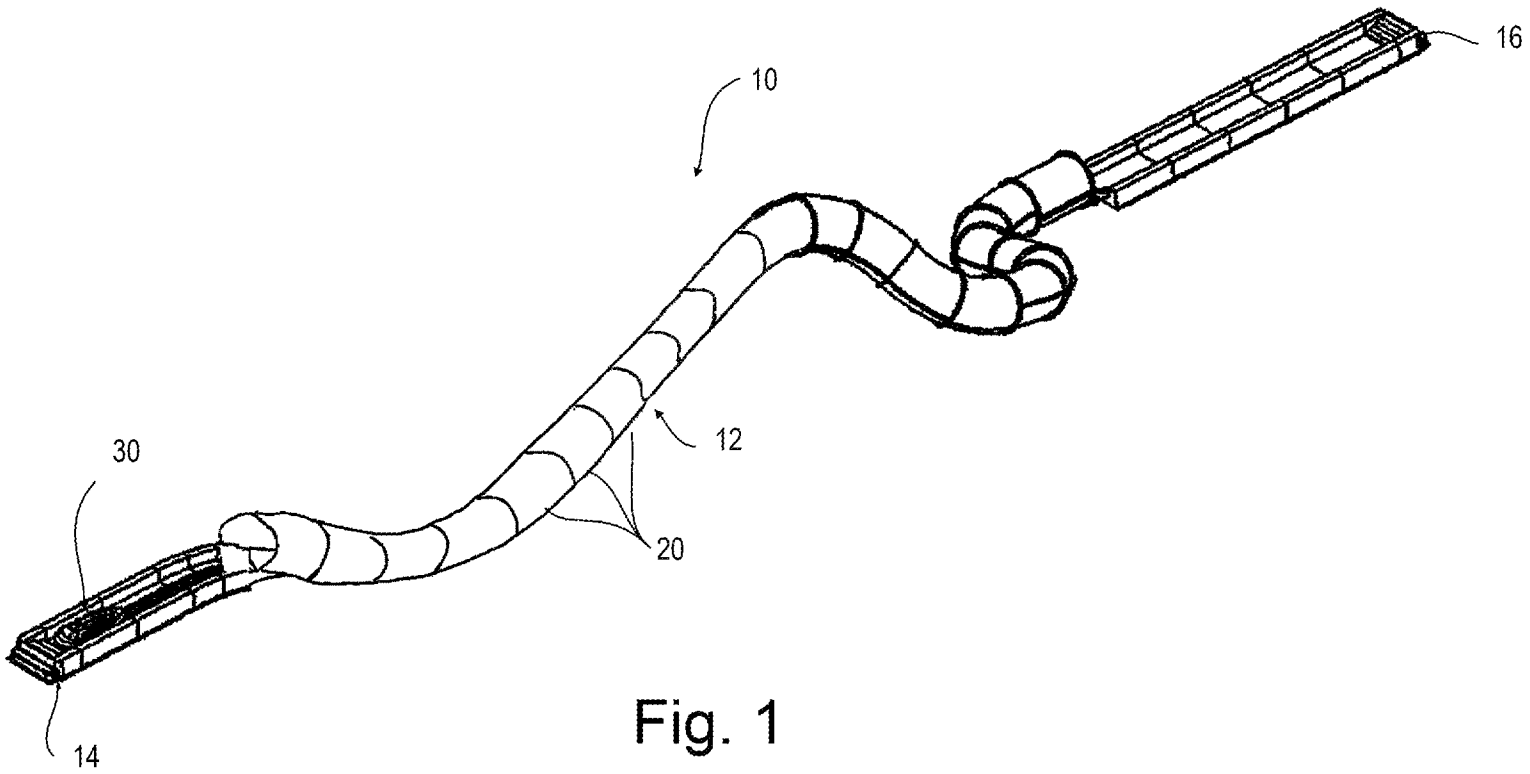
FIG. 1 is a perspective view of the disclosed water slide.

Referring to FIG. 1, is shown one example of the disclosed water slide 10. The water slide 10 comprises an elongate track 12 (water slide) having a beginning 14 and an end 16. The track 12 in one example is formed of a plurality of substantially tubular track portions 20 as will be more fully described below. As illustrated in FIG. 1, the track 12 includes at least one vehicle 30 operable to be received within the track as will be more fully described below.

In this disclosure, specific examples of a structure will have an alphabetic suffix attached to the label. For example, specific examples of the vehicle 30 may be denoted 30*a*, 30*b*, 30*c*, etc.

Figure 2:
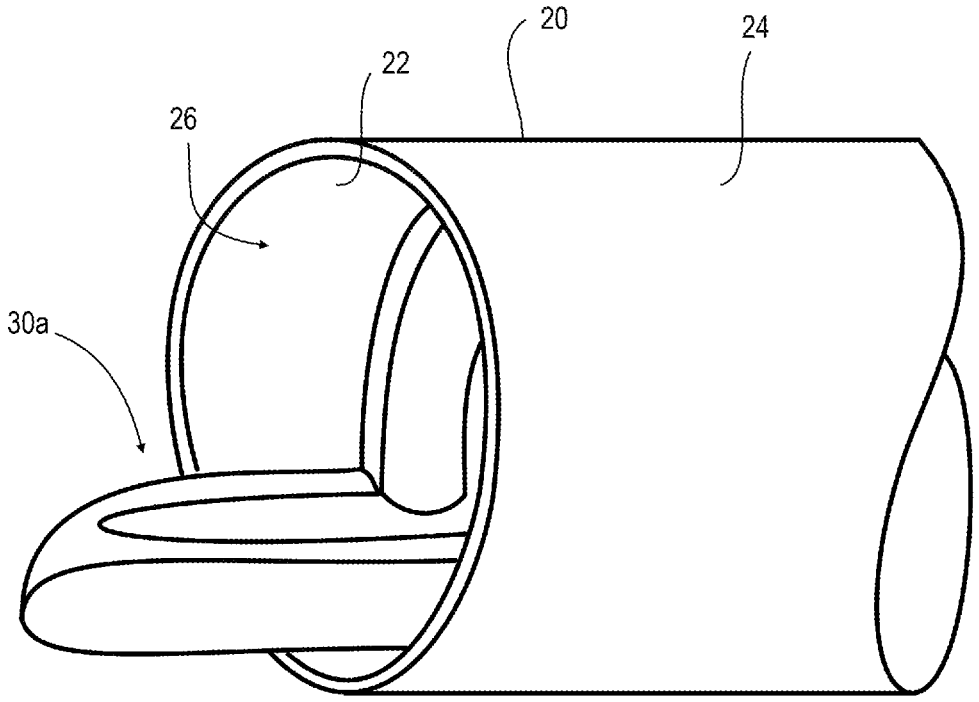
FIG. 2 is a perspective view of a section of the water slide track of FIG. 1 with one example of a vehicle located therein.
Figure 14:
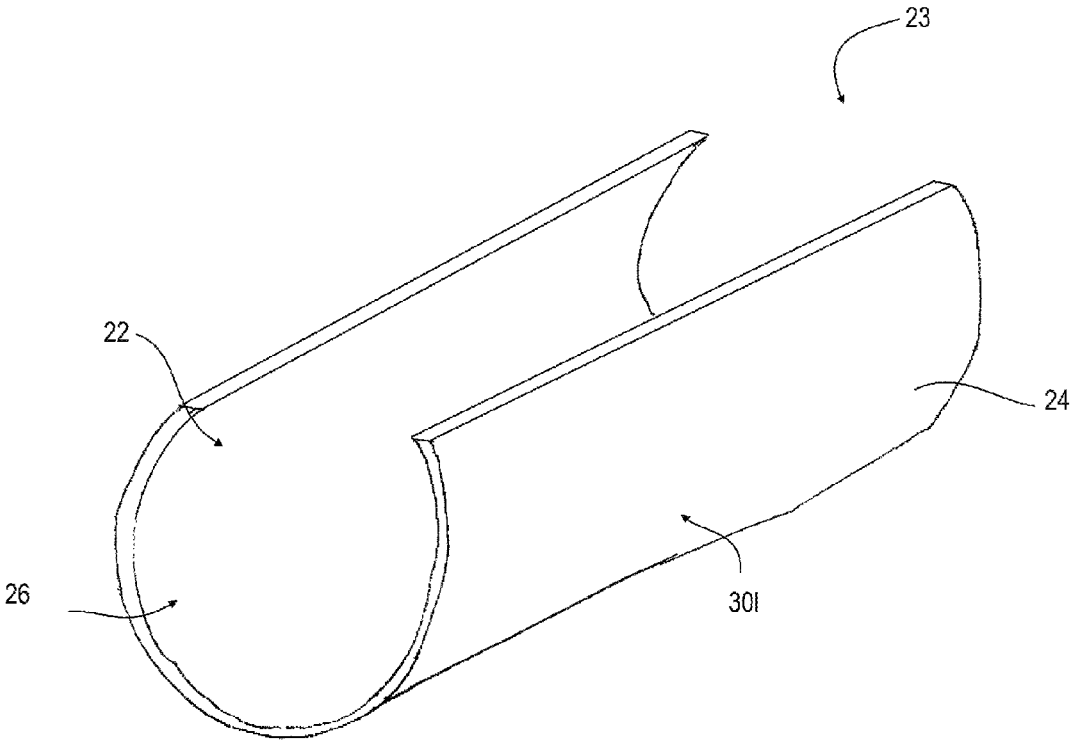
FIG. 14 is a perspective view of one example of the disclosed vehicle for use in the water slide of FIG. 1.

Turning now to FIG. 2, one cylindrical (tubular) track portion 20 (section) is illustrated. Each track portion 20 comprises one or more substantially tubular member(s) having inner and outer surfaces, 22 and 24, respectively wherein the inner surface 22 defines a track path 26. The track 20 is sized to receive a rider located on a vehicle 30 which slidably traverses the water slide 10. Optionally, each track portion 20 may be have surfaces defining an opening slot 23 extending therealong as illustrated in FIG. 14. In such examples, the vehicle 30 may be supported in the bottom thereof and permitted to rotate therein.

Figure 3:
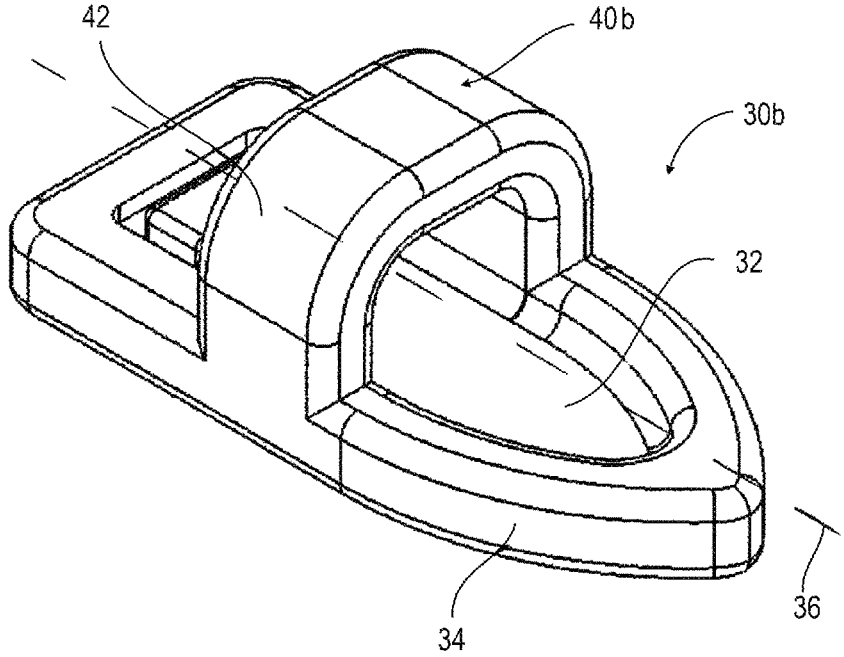
FIG. 3 is a perspective view of one example of the disclosed vehicle for use in the water slide track of FIG. 1.
Figure 4:
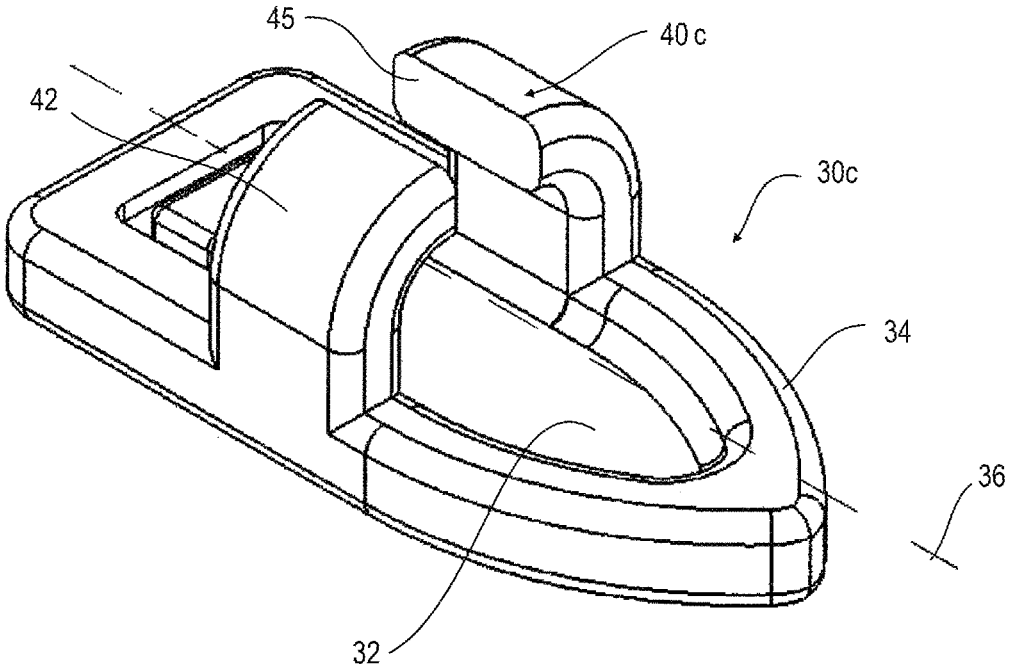
FIG. 4 is a perspective view of one example of the disclosed vehicle for use in the water slide track of FIG. 1.

Turning now to FIGS. 3 and 4, the vehicle 30*b* and 30*c* respectively for use in the track is shown comprising a support platform 32 sized to receive a rider thereon. The support platform 32 may be formed as a rigid or semi-rigid body of appropriate materials such as, by way of non-limiting example, plastic, composite materials, metals and the like. The support platform 32 may be covered by a cushioning material such as, by way of non-limiting example, foam or the like to aid in rider comfort. The support platform 32 may also be formed of an inflatable body, such as a tube or the like as are commonly known in the art. As illustrated in the examples of FIGS. 3 and 4, the support platform 32 may optionally include a barrier wall or member 34 extending around a periphery thereof. The barrier wall 34 has a height selected to retain a rider upon the support platform 32 during operation and may be formed of a rigid or semi-rigid material, such as, by way of non-limiting example, plastic, composite materials, metals or may optionally be formed of an inflatable or padded body.

Figure 5:
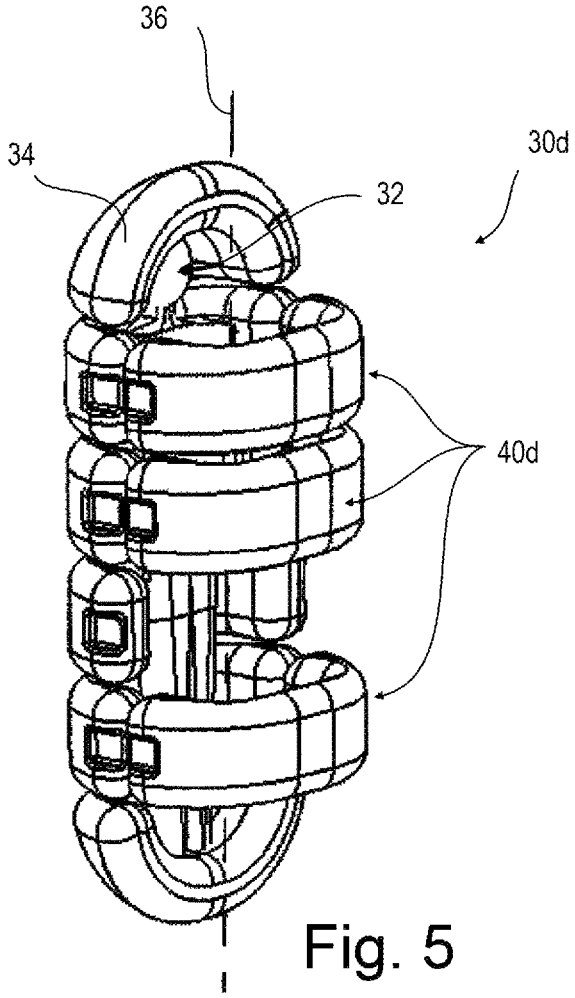
FIG. 5 is a perspective view of one example of the disclosed vehicle for use in the water slide track of FIG. 1.

This example of the vehicle 30 includes a retaining member 40 extending over the support platform 32. The retaining member 40 of this example comprising a rigid member having an outer riding surface 42 selected to have a low coefficient of friction. The retaining member 40 substantially extends along an arcuate path around an axis 36 of the vehicle 30 so as to have an outer dimension substantially corresponding to the inner surface 22 of the track 12. As illustrated in the example of FIG. 3, the retaining member 40 may be formed of a solid member or may optionally include a gap or break 45 therein as illustrated in FIG. 4 to assist a rider entering the vehicle 30. Additionally, although a single retaining member 40 is illustrated in FIGS. 3 and 4, a plurality of retaining members 40 may be provided along the common axis 36 of the vehicle 30 as illustrated in FIG. 5.

When the vehicle 30 is located within a track 12, it will be observed that the position of the vehicle 30 with the support portion 32 is adjacent to or in contact with the inner surface 22 of the track. In such a way, the vehicle may be permitted to rotate about the axis 36 while traveling along the track 12 without the vehicle tipping over or dislodging the rider. Additionally, in some examples, the vehicle 30 may be configured to slidably rest on the retaining surface(s) 40 when the vehicle 30 is upside down (inverted). It will be appreciated that such a vehicle 30 will permit the design of waterslides 10 not previously possible such as, by way of non-limiting example, loops, vertical drops, spirals and the like wherein the support portion 32 may be temporarily or indefinitely adjacent to the top of the track while the vehicle 30 and rider are riding on and may be supported by the retaining member 40.

Figure 6:
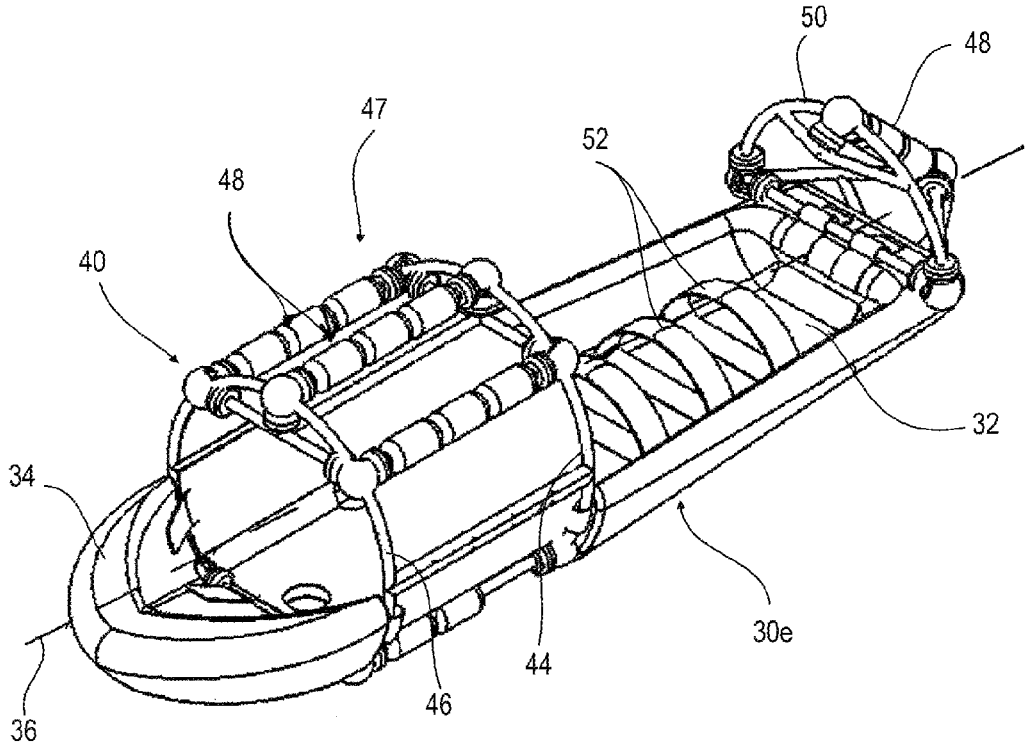
FIG. 6 is a perspective view of one example of the disclosed vehicle for use in the water slide track of FIG. 1.

Turning now to FIG. 6, an alternative embodiment of the vehicle 30*e* is illustrated in which the retaining member 40 is formed of a space frame 47 supported between front and rear loop members, 44 and 46, respectively. The loop members 44 and 46 of this example include a plurality sliding members 48 extending between loop members 44 and 46. The sliding members 48 may be supported on rigid bars extending through the sliding members 48 and supported on opposite ends by the loop members 44 and 46. As illustrated in FIG. 6, the vehicle may also include a leading retaining member 50 located at a leading edge thereof which is formed of a space frame having a plurality of sliding members 48 there along as well. As illustrated in FIG. 6, the support platform 32 may include one or more harnesses 52 for restraining the rider within the vehicle. The harness 52 may be is formed of a selectably fastenable belt or the like.

Figure 7:
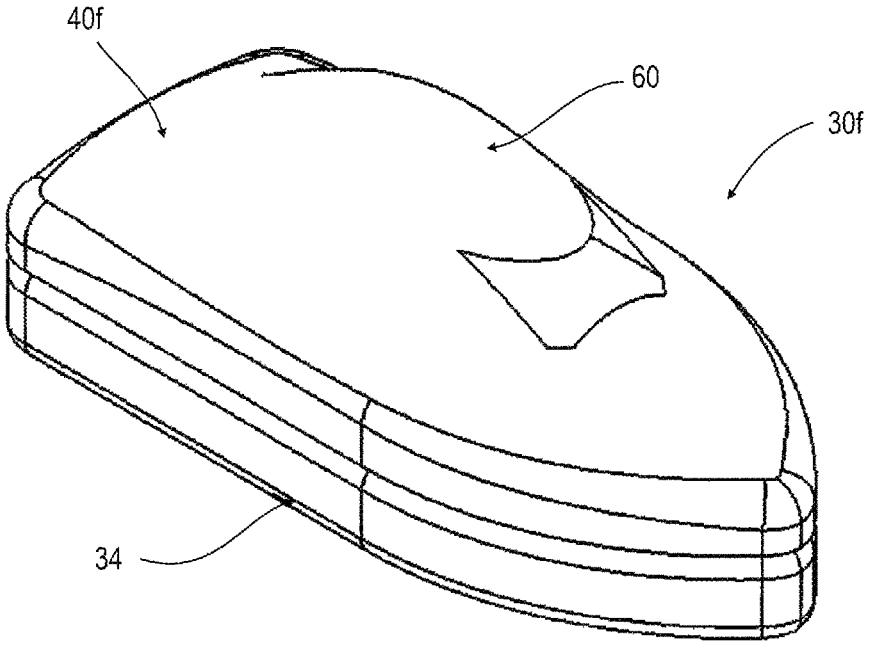
FIG. 7 is a perspective view of one example of the disclosed vehicle for use in the water slide track of FIG. 1.

Turning now to FIG. 7, the retaining member 40 may optionally comprises a shell 60 having an outline substantially corresponding to the support platform 32 and barrier wall 34.

Figure 9:
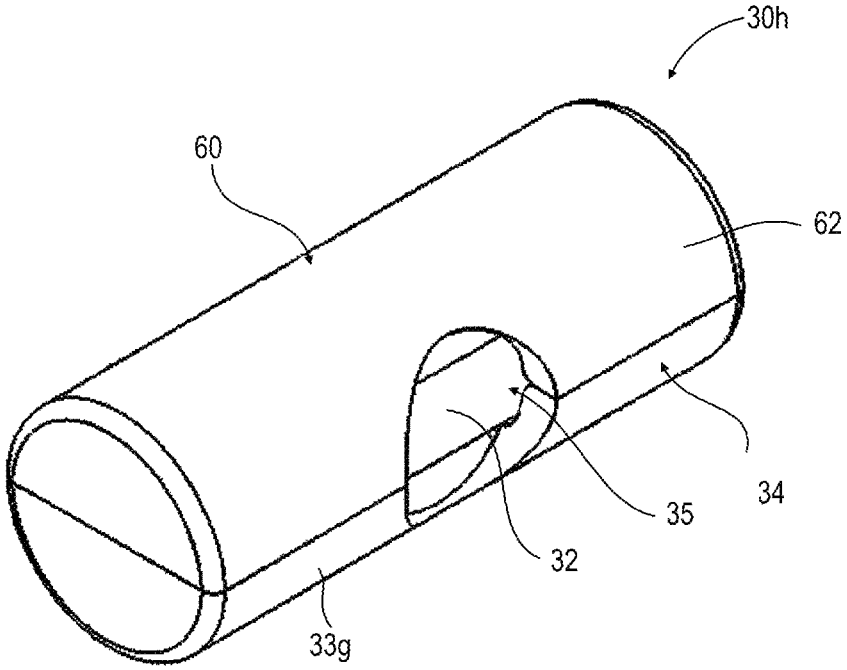
FIG. 9 is a perspective view of one example of the disclosed vehicle for use in the water slide track of FIG. 1.
Figure 10:
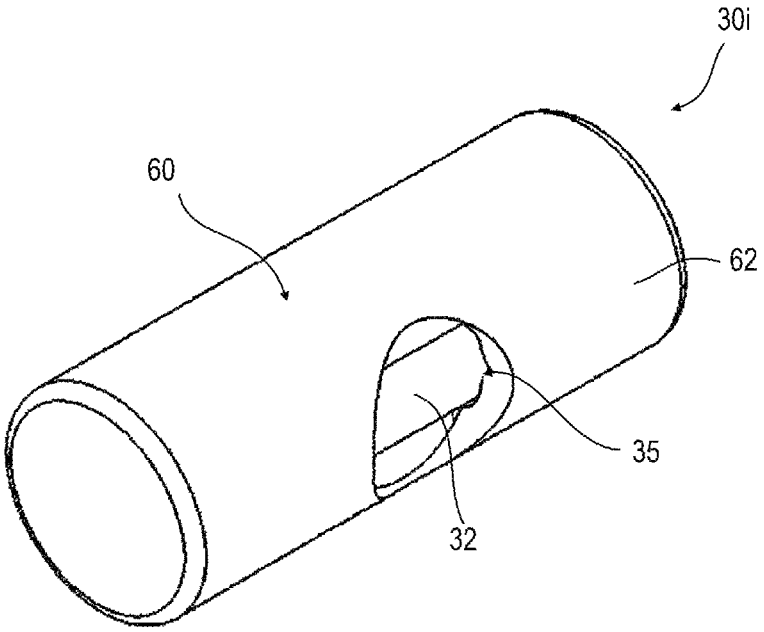
FIG. 10 is a perspective view of one example of the disclosed vehicle for use in the water slide track of FIG. 1.

As illustrated in FIGS. 9 and 10, the shell 60 may have a substantially cylindrical outer surface 62 so as to co-operate with a substantially cylindrically shaped outer surface 33 of the support platform 32 so as to provide a cylindrical overall cross section when mated together. Optionally, the outer shell 60 and outer surface 33 of the support platform 32 may be co-formed with each other as shown in FIG. 10 with an access port 35 provided for a rider to access (enter) the interior of the vehicle 30*i*.

Figure 8:
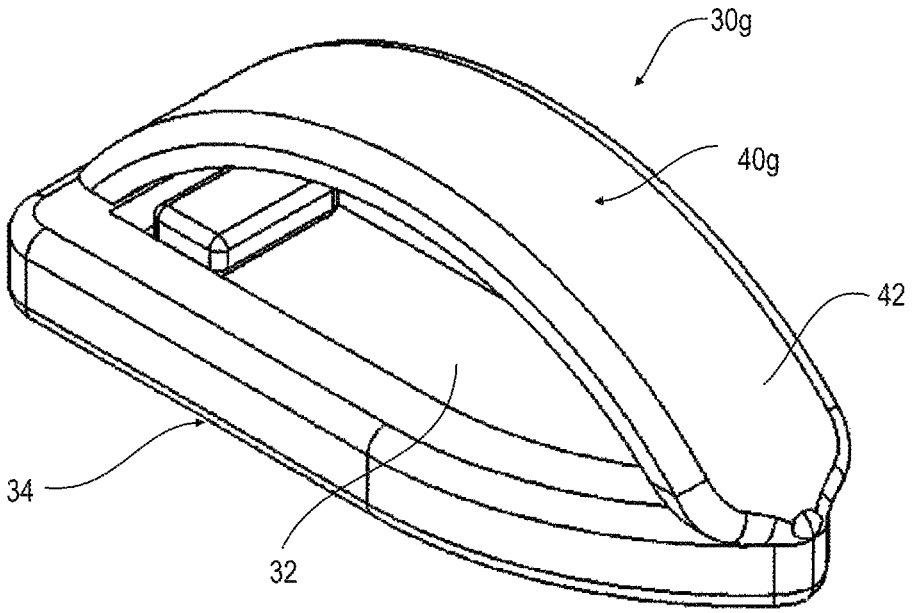
FIG. 8 is a perspective view of one example of the disclosed vehicle for use in the water slide track of FIG. 1.

Additionally, as illustrated in FIG. 8, the retaining member 40 may extend lengthwise along the vehicle 30*g*.

Figure 11:
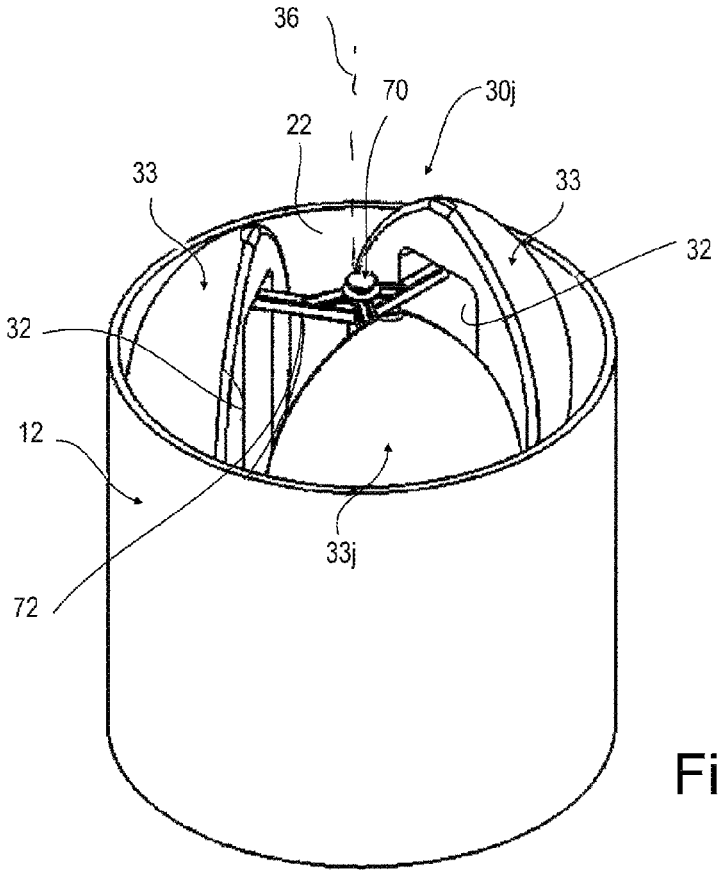
FIG. 11 is a perspective view of one example of the disclosed vehicle for use in the water slide track of Fig.
Figure 12:
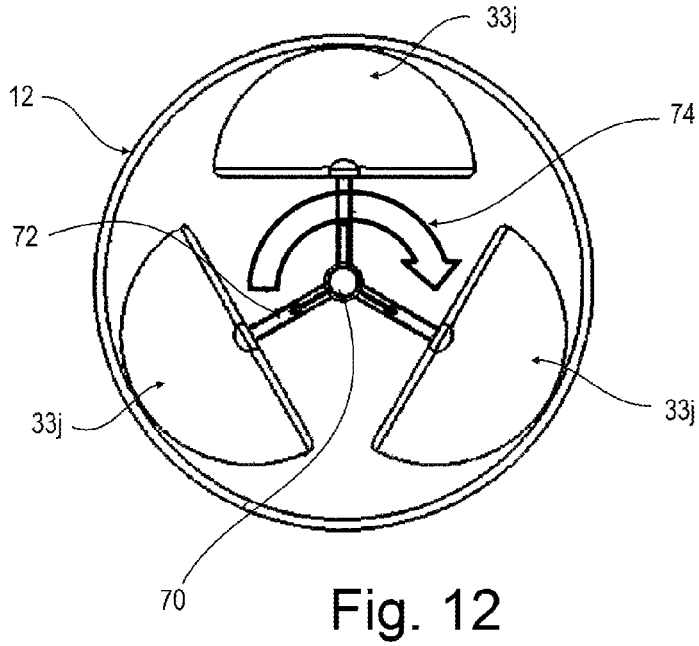
FIG. 12 is a perspective view of one example of the disclosed vehicle for use in the water slide track of FIG. 1.

Turning now to FIGS. 11 and 12; an alternative example is illustrated, in which a plurality of support platforms 32 are provided. Each support platform of this example has an outer cylindrical or curved surface 33. In one example, a coupling frame 70 is provided between the individual support platforms 32 so as to radially space them apart from each other by a distance, with the outer diameter of the overall vehicle 30*j* corresponding to the inner diameter of the inner surface 22 of the track 12. As illustrated in FIG. 12, when the vehicle 30*j* is positioned within the track 12, the support platforms 32 are permitted to rotate about the axis 36 of the vehicle as illustrated generally at 74. Although three support platforms are illustrated in the examples of FIGS. 11 and 12, it will be appreciated that other numbers of support platforms may also be used.

As disclosed above, the support platform 32 may be sized to receive a single rider thereon. It will also be appreciated that the support platform(s) may also be sized to receive more than one rider. Additionally, more than one support platform 32 may be provided.

Figure 13:
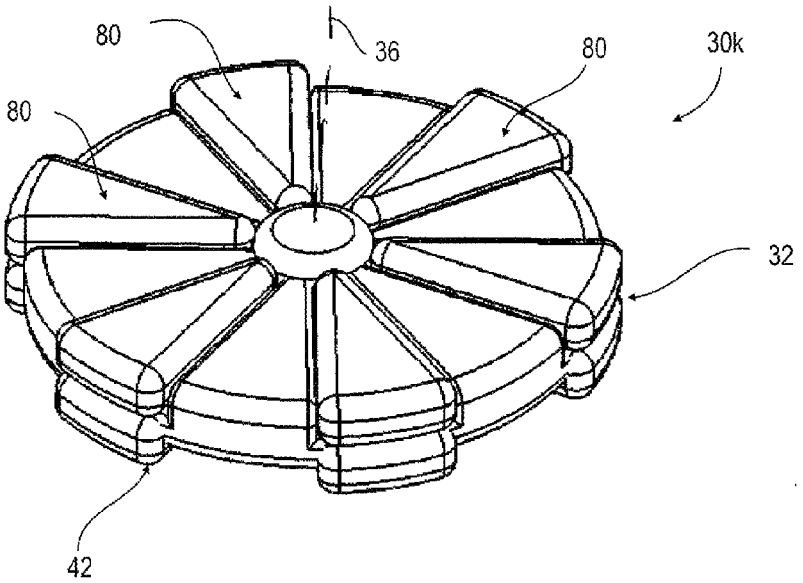
FIG. 13 is a perspective view of one example of the disclosed vehicle for use in the water slide track of FIG. 1.

With reference to the example of FIG. 13, a plurality of support platforms may be provided, with one located within each of a plurality of pods 80 arranged radially around the axis 36. Each pod may include the sliding surface 42 on the outer annular surface thereof.

While specific embodiments of the invention have been described and illustrated, such embodiments should be considered illustrative of the invention only and not as limiting the invention as construed in accordance with the accompanying claims.

What is claimed is:

1. A vehicle for conveying a rider within a tubular waterslide track, the vehicle comprising:

a support portion for supporting said rider; the support portion having a first longitudinal side and a radially opposing second longitudinal side the tubular waterslide track having a longitudinal axis;

a retaining body having a sliding portion extending circumferentially about the longitudinal axis from the first longitudinal side of the support portion to the opposing second longitudinal side of the support portion, the retaining body configured to contact an interior wall of said tubular waterslide track, said retaining body having a sliding surface for sliding engagement with said wall of said tubular waterslide track; and wherein said support portion and said retaining body have a vehicle axis of movement parallel to the longitudinal axis of the waterslide track about which said vehicle may rotate within said tubular waterslide track such that axial rotation is facilitated, and non-axial rolling is prohibited by way of the sliding surface of the retaining body contacting the inner surface of the waterslide track.

2. The vehicle of claim 1 wherein said support portion comprises a substantially planar body adapted to support a rider.

3. The vehicle of claim 2 wherein said support portion is sized to receive a single rider in a prone position.

4. The vehicle of claim 2 wherein, said planar body includes a barrier wall extending around a periphery thereof.

5. The vehicle of claim 4 wherein said barrier wall is inflatable.

6. The vehicle of claim 2 wherein said planar body is inflatable.

7. The vehicle of claim 2 wherein said planar body extends substantially parallel to said vehicle axis.

8. The vehicle of claim 1 wherein said planar body includes a harness for securing a rider thereto.

9. The vehicle of claim 1 wherein said retaining body comprises a ring extending from said support portion around said vehicle axis.

10. The vehicle of claim 1 further comprising a plurality of retaining bodies.

11. The vehicle of claim 1 wherein said retaining body comprises a shell extending from said support portion.

12. The vehicle of claim 11 wherein said shell comprises a semi-cylindrical shell matable to said support portion.

13. The vehicle of claim 11 wherein said support portion comprises a semi-cylindrical body adapted to form a cylinder in cooperation with said shell.

14. The vehicle of claim 1 wherein said retaining body is formed of an inflatable body.

15. The vehicle of claim 1 further comprising a plurality of support portions extending radially from an axis of said vehicle wherein each support portion includes a retaining body located at an outer radial surface thereof.

16. The vehicle of claim 1 being operable to be supported by and slidable on said sliding surface of said retaining body.

17. The vehicle of claim 1 wherein said vehicle has an axial length substantially larger than an exterior diameter, wherein the exterior diameter is substantially equal to an interior diameter of said tubular waterslide track.

18. An apparatus for transporting a rider comprising:

a tubular waterslide track having an interior wall and a longitudinal axis;

at least one vehicle comprising:

a support portion for supporting said rider, the support portion having a first longitudinal side and a radially opposing second longitudinal side; and a retaining body having a sliding portion extending circumferentially about the longitudinal axis from the first longitudinal side of the support portion to the opposing second longitudinal side of the support portion, the retaining body configured to contact an interior wall of said tubular waterslide track, said retaining body having a sliding surface for slidable engagement with said wall of said tubular waterslide track, wherein said support portion and said retaining body have a vehicle axis of movement parallel to the longitudinal axis of the waterslide track about which said vehicle may rotate within said tubular track where non-axial is prohibited by way of the sliding surface of the retaining body contacting the inner surface of the waterslide track.

19. The apparatus of claim 18 wherein said waterslide track has an opening therealong.

* * * * *